US005447041A

United States Patent [19]

Piechota

[11] Patent Number: 5,447,041

[45] Date of Patent: Sep. 5, 1995

[54] COVER AND BUILT-IN AUDIO SYSTEM FOR AN INSULATED COOLER

[76] Inventor: Joseph P. Piechota, 60 Reservoir Ave., Wallington, N.J. 07057

[21] Appl. No.: 345,833

[22] Filed: Nov. 28, 1994

[51] Int. Cl.[6] ..... F25D 3/08

[52] U.S. Cl. ..... 62/457.7; 206/542; 220/212; 220/521; 312/71; 312/405.1; 455/344; 455/351

[58] Field of Search ..... 62/457.1, 457.7; 455/344, 348, 349, 351; 206/542; 220/212, 521; 312/7.1, 237, 248, 405, 405.1

[56] References Cited

U.S. PATENT DOCUMENTS 4,279,342 7/1981 Van Pelt ..... 206/542
4,571,740 2/1986 Kirby et al. ..... 455/344
4,700,395 10/1987 Long ..... 381/90
4,817,191 3/1989 Adams ..... 455/351
4,939,912 7/1990 Lenovich, Jr. ..... 62/457.1
5,235,822 8/1993 Lenovich, Jr. ..... 62/457.7

*Primary Examiner*—William E. Tapolcai
*Attorney, Agent, or Firm*—Ezra Sutton

[57] ABSTRACT

A cover apparatus that provides a cover member having a recessed cavity having four sidewalls and a bottom wall. An audio system is hingedly mounted on a sidewall of the recessed cavity and is movable between a closed position, wherein the audio system lies flat on the bottom wall within the recessed cavity and an open position, wherein the audio system extends outwardly from the recessed cavity. A cover panel is also hingedly mounted on an opposite sidewall of the recessed cavity and is movable between a closed position, wherein the cover panel closes the recessed cavity and lies flat on the audio system and an open position, wherein the cover panel extends outwardly from the recessed cavity. The audio system and cover panel are maintained in an open and upright position by a support stand.

20 Claims, 6 Drawing Sheets

COVER AND BUILT-IN AUDIO SYSTEM FOR AN INSULATED COOLER

FIELD OF THE INVENTION

This invention relates to a cover for an insulated cooler, wherein the cover has a built-in audio system in the form of a radio, compact disc player, or tape cassette.

BACKGROUND OF THE INVENTION

Portable insulated coolers and chests for food and ice having a radio or audio system are known in the art. Typically, these insulated containers are used to carry food and beverages to the beach, mountains, lake areas, or on boats, where the user can listen to music, news, or talk show programming while enjoying the food and/or beverages contained within the cooler.

DESCRIPTION OF THE PRIOR ART

Insulated coolers that have audio units have them built in or connected to the main body of the cooler. Typically, the audio unit is recessed into a front wall or attached to the front wall surface. For example, U.S. Pat. No. 4,817,191 to Adams and U.S. Pat. No. 5,235,822 to Leonovich, Jr. both disclose a portable insulated cooler having a radio receiver unit with loudspeakers placed within a recessed cavity on the front wall of the cooler.

U.S. Pat. No. 4,571,740 to Kerby et al, U.S. Pat. No. 4,700,395 to Long, and U.S. Pat. No. 4,939,912 to Leonovich, Jr. all disclose a portable insulated cooler having a radio system mounted on the front wall and having speakers attached to the sidewalls or front wall of the cooler.

These prior art coolers having audio units are exposed to the elements, such as rain, dirt, dust, sand, and the like (whether in use or not), and they do not have any type of covering to protect them from this type of weathering.

Also, these prior art coolers are unprotected from normal wear and tear, as these audio systems are bumped into, dropped on the ground, hit by objects, i.e., balls, frisbees, stones, and the like.

These prior art coolers also present the problem of being off balance because the audio systems may be relatively heavy and positioned in an off-center manner. Such an off-center location causes the cooler to tip to one side, which makes it more difficult and awkward to carry by the user.

Accordingly, it is an object of the present invention to provide a cover apparatus having an audio system contained within that is protected from normal weathering when in use.

Another object of the present invention is to provide a cover apparatus having an audio system contained within that is protected from normal wear and tear when in use.

Another object of the present invention is to provide a cover apparatus having an audio system wherein the cover is interchangeable with cooler covers for other coolers.

Another object of the present invention is to provide a cover apparatus having an audio system that is easily accessible and is simple to set up for use.

Another object of the present invention is to provide a cover apparatus having an audio system contained within, wherein the weight and location of the audio system is substantially in the center of the cover member for better balance and ease of carrying the cooler.

Another object of the present invention is to provide a cover apparatus having an audio system contained within which is water and liquid proof.

A further object of the present invention is to provide a cover apparatus having an audio system that is interchangeable with standard AM/FM radios, compact disc players, and/or tape cassettes.

It is a still further object of the present invention to provide a cover apparatus having an audio and visual system contained within, such as a color television.

A still further object of the present invention is to provide an economical and efficient method of constructing a cover apparatus having an audio and/or visual system contained within.

SUMMARY OF THE PRESENT INVENTION

The present invention provides a cover apparatus for an insulated cooler having a built-in audio system. The cover apparatus includes a cover member having a recessed cavity for receiving the cover panel and audio system. Both the cover panel and the audio system are hingedly connected to opposite sidewalls of the recessed cavity. Both the cover panel and the audio system have support devices for keeping the cover panel and the audio system in an open and upright configuration.

The cover member is constructed such that it is interchangeable with other standard cover lids of insulated coolers. The audio system is a standard system and is interchangeable with commonly-manufactured AM/FM radios, CD players, and/or tape cassettes which can be used within the recessed cavity of the cover member.

The cover apparatus is waterproof to eliminate damage when in use. In addition, the center of gravity of the cover apparatus is such that the cooler is balanced.

BRIEF DESCRIPTION OF THE DRAWINGS

Further objects, features, and advantages of the present invention will become apparent upon consideration of the detailed description of the presently-preferred embodiments, when taken in conjunction with the accompanying drawings, wherein.

DETAILED DESCRIPTION OF THE PRESENT INVENTION

Figure 1:
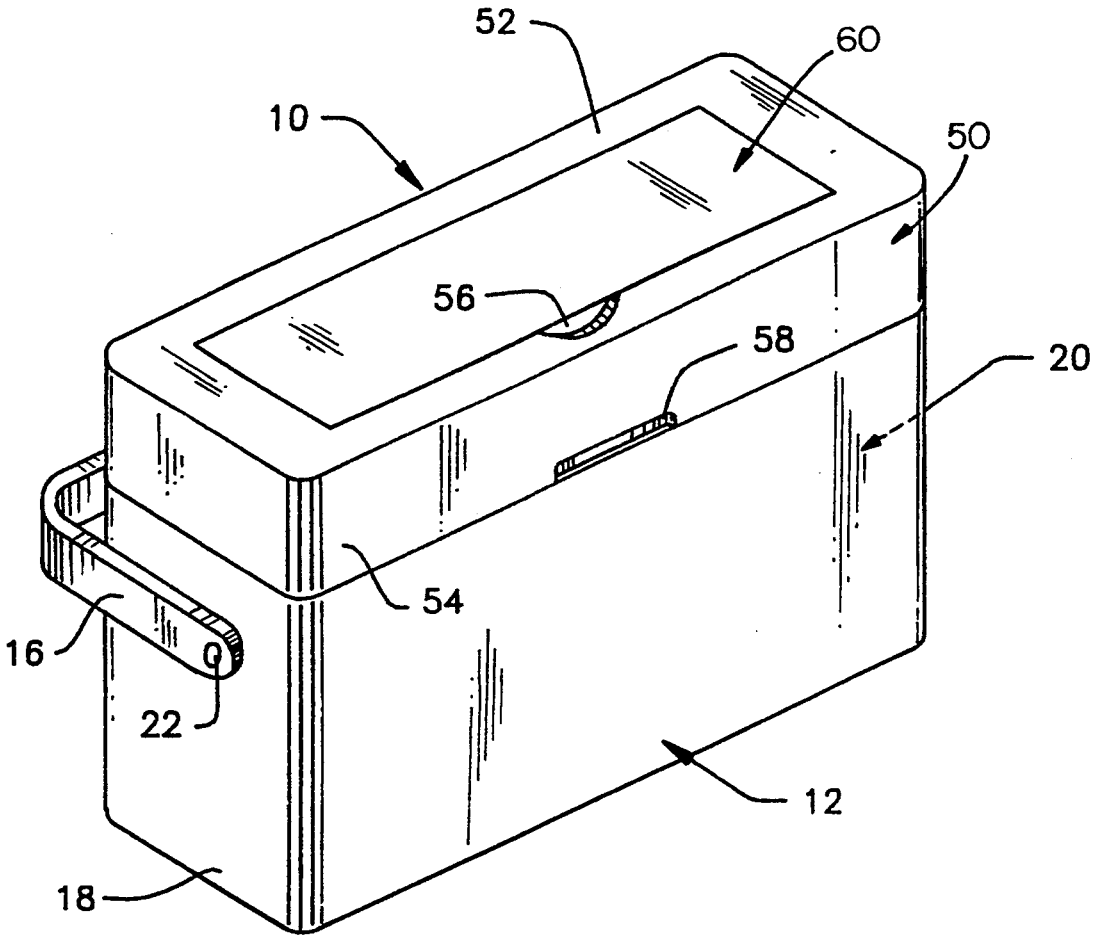
FIG. 1 is a perspective view of the present invention of a cooler and cover apparatus having an audio system contained therein showing the cover apparatus in its closed configuration.
Figure 2:
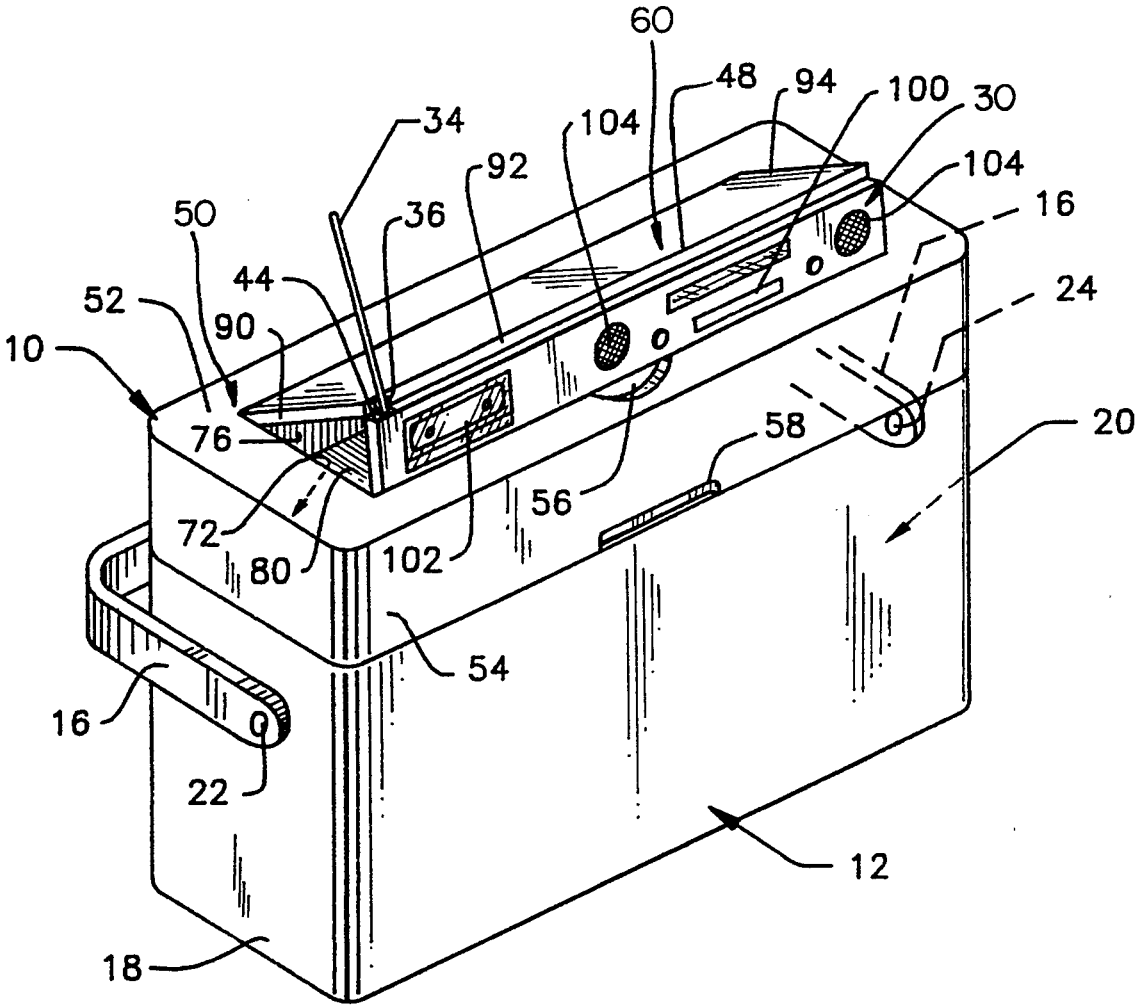
FIG. 2 is a perspective view of the cooler and cover apparatus showing the audio system and cover panel in an opened and upright position.

The cover apparatus 10 for an insulated cooler 12 including an audio system 30 and other component parts is represented in FIGS. 1 through 6 of the present invention. The cover apparatus 10 having an audio system 30 includes a cover member 50 having a top surface 52, a front surface 54, a cover panel 60, and a recessed cavity 70, as depicted in FIGS. 1 and 2.

Figure 3:
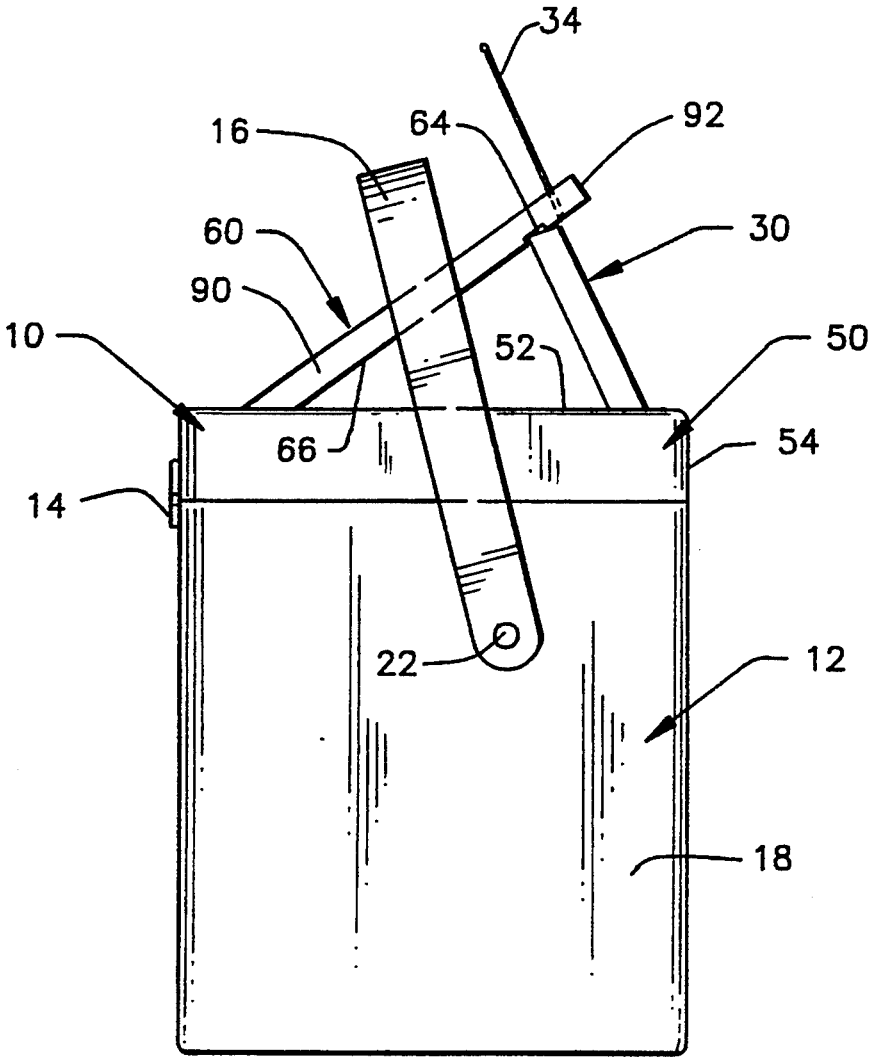
FIG. 3 is a side view of the cooler and cover apparatus which shows the handle, cover panel, and audio system in an upright position.

As shown in FIG. 2, the cover member 50 has a molded indentation 56 located on the top surface 52 for lifting and opening of cover panel 60 and a molded indentation 58 located on the front surface 54 for lifting and opening the cover member 50 from the closed position on cooler 12. The cover member 50 is attached to cooler 12 by a connecting hinge 14, and in another embodiment, cover member 50 is removable as a whole unit and is not hingedly connected. A carrying handle 16 is attached to cooler walls 18 and 20 and pivots about pivot points 22 and 24, which enables access to cover member 50 when needed to open the cooler 12 for food and/or beverages. When the handle 16 is in a vertical position, as shown in FIGS. 3 and 5, the handle 16 clears the tops of both cover panel 60 and audio system 30 when in their upright and open positions.

Figure 4:
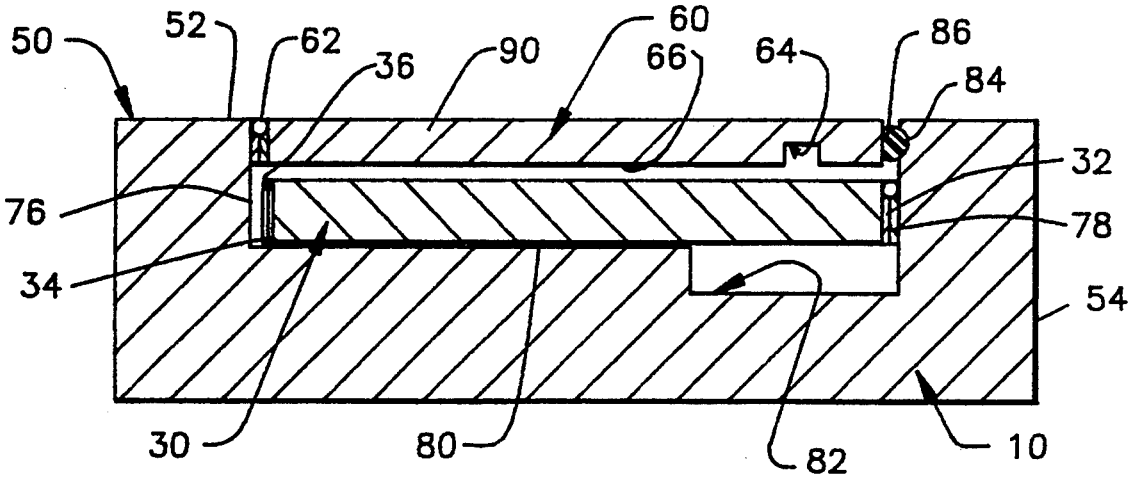
FIG. 4 is a sectional view of the cover apparatus showing the cover panel and the audio system in its closed configuration.

The recessed cavity 70 of cover member 50 includes sidewalls 72, 74, 76, and 78 and a bottom wall 80 for storing of the audio system 30 and for receiving the cover panel 60, so that it lies above audio system 30 when in the closed position. The recessed cavity 70 also includes a storage compartment 82 formed within the bottom wall 80 for storing of car keys, batteries, music tapes, or CDs, and/or antenna wire. In the upper section of sidewalls 72, 74, and 78 of the recessed cavity 70, there is a receiving and holding groove 84 for a sealing gasket 86, as shown in FIGS. 4 and 5. This makes the exterior cover panel 60 impervious to liquids (waterproof cover member) and particulate matter, when in the closed position, thus protecting the audio system 30 from damage.

Figure 5:
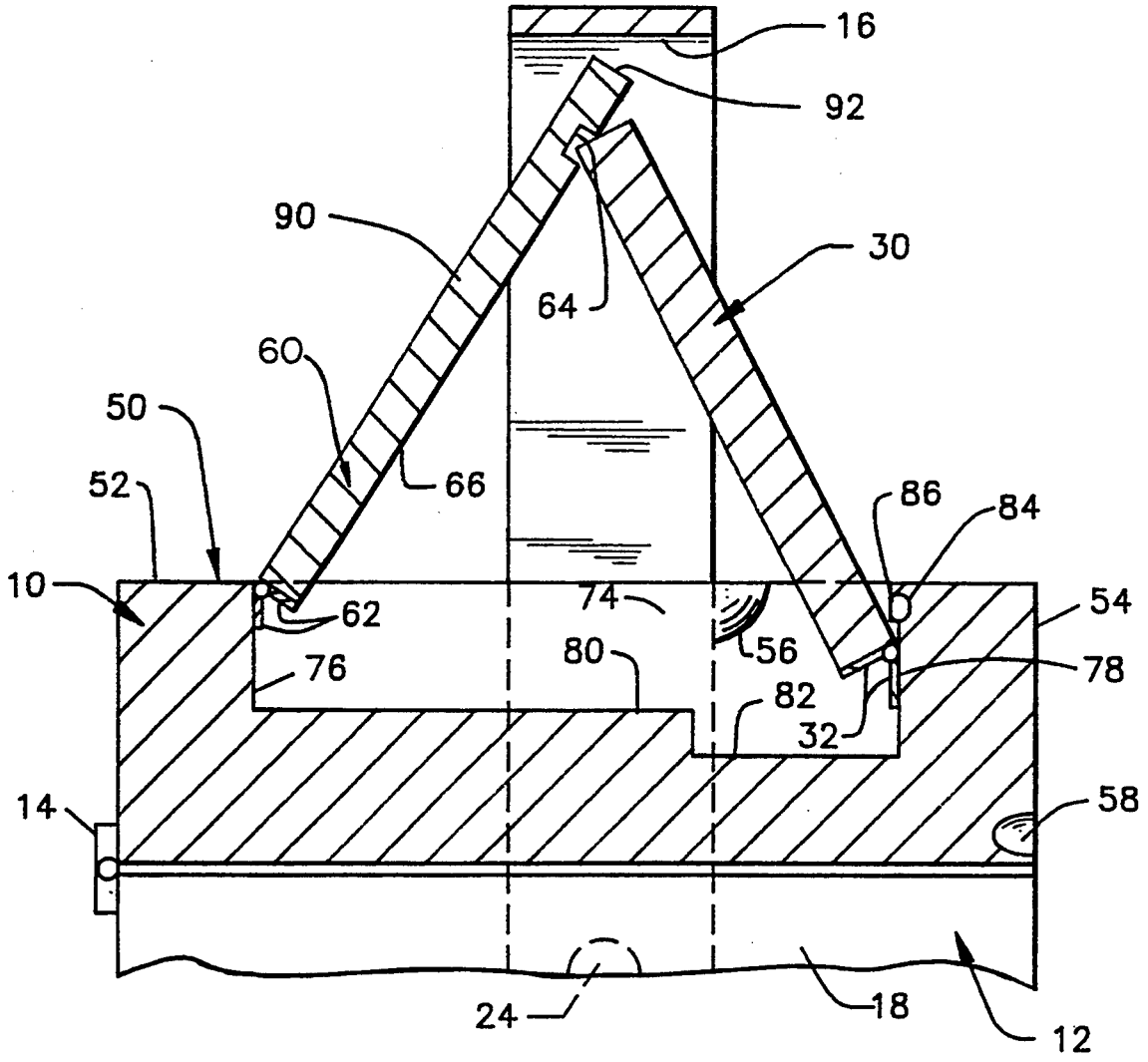
FIG. 5 is a partial sectional view of the cooler and cover apparatus showing the cover panel and the audio system in its open and upright configuration.
Figure 6:
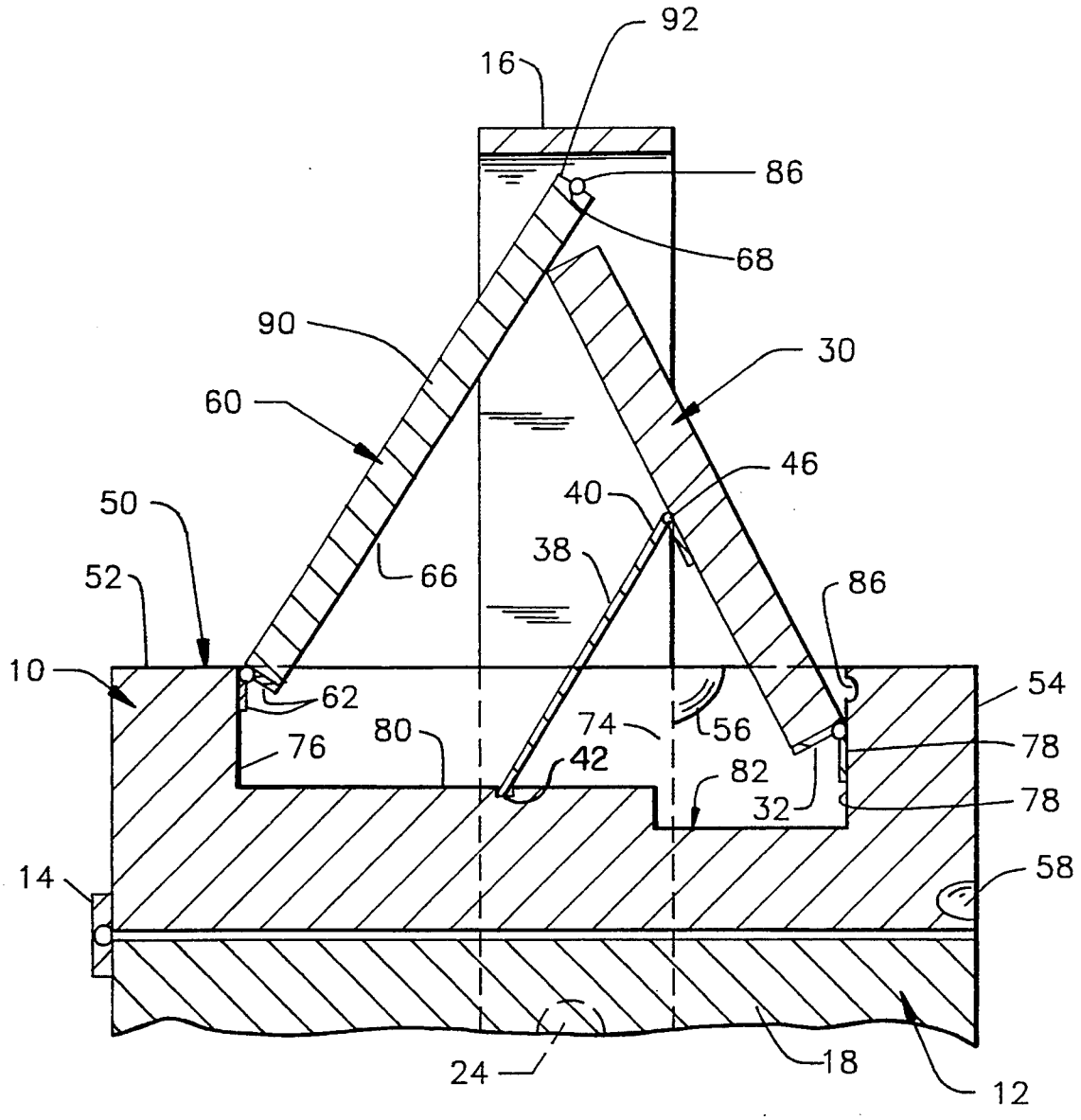
FIG. 6 is a partial sectional view of the cooler and cover apparatus of another embodiment showing the cover panel and the audio system with a support stand in its open and upright configuration.

As shown in FIG. 5, the audio system 30 is hingedly attached by hinge 32 to the recessed front sidewall 78 and lies flat on the bottom wall 80 of recessed cavity 70 when in the closed position. The audio system 30 includes a movable and adjustable telescoping audio antenna 34 that is hingedly connected to the top left corner 44 of audio system 30 by an antenna hinge 36. The audio system 30 also includes a support stand 38 that is hingedly connected to the center point of back member surface 46 of audio system 30 by a support stand hinge 40. The support stand 38 is placed in the support stand indentation 42 located on bottom wall 80, which holds audio system 30 in an open and upright position when the audio system 30 is in use, as depicted in FIG. 6 of the present invention.

The audio system 30 is made as a single-piece unit having an AM/FM radio receiver 100, tape cassette 102, and stereo speakers 104, as shown in FIG. 2 of the present invention. In other embodiments, audio system 30 can have a combination of an AM/FM radio receiver 100, tape cassette 102, compact disc player (not shown), and stereo speakers 104 which are standard manufactured units that are interchangeable replacements for use as an audio system 30 within recessed cavity 70 of cover apparatus 10 of the present invention.

In another embodiment (not shown), the cover apparatus 10 includes an audio and visual unit contained therein being a transistorized, liquid crystallized display color television.

As shown in FIG. 5, cover panel 60 is hingedly attached by hinge 62 to the recessed rear sidewall 76 and lies flat on the audio system 30 within the recessed cavity 70 when in the closed position. The cover panel 60 has a molded indentation 64 on the bottom wall 66, which is used for receiving and engaging a corner 48 of audio system 30 to hold it in an open and upright position when the audio system 30 is in use.

In the embodiment of FIG. 6, the audio system 30 has a different support, which includes a support stand 38 hingedly connected by hinge 40 to the back surface center area 46 of audio system 30. The support stand 38 is placed in the support stand indentation 42, which holds both cover panel 60 and audio system 30 in an open and upright position and ready for use.

In another embodiment (not shown), cover panel 60 has a support stand 38 hingedly connected to the cover panel 60. The support stand 38 is placed in the support stand indentation 42, which holds both cover panel 60 and the audio system 30 in an open and upright position, so that audio system 30 is ready for use.

In the aforementioned embodiment of FIG. 6, cover panel 60 has a receiving and holding groove 68 for a sealing gasket 86. The groove 68 is located on the three side edges 90, 92, and 94 of cover panel 60. The sealing gasket 86 makes the exterior cover panel 60 and cover member 50 waterproof when sealing gasket 86 is received in groove 84 of sidewall 78 in the recessed cavity 70. In the embodiment of FIG. 5, sealing gasket 86 is mounted in a groove 84 located on the upper sidewalls 72, 74, and 78 of recessed cavity 70.

The cover panel 60 and audio system 30 are centrally disposed within the recessed cavity 70 of cover member 50, such that in the closed position or in the open and upright configuration, the cover apparatus 10 and insulated cooler 12 may be carried by handle 16 in a balanced manner, without any awkward tipping of cooler 12.

The cover panel 60 can be made of reinforced plastic or metal and be in the shape of a circle, square, rectangle, or oval. The sealing gasket 86 used for waterproofing cover member 50 is made of rubber, Teflon, cork, or pliable plastic tubing.

Figure 7:
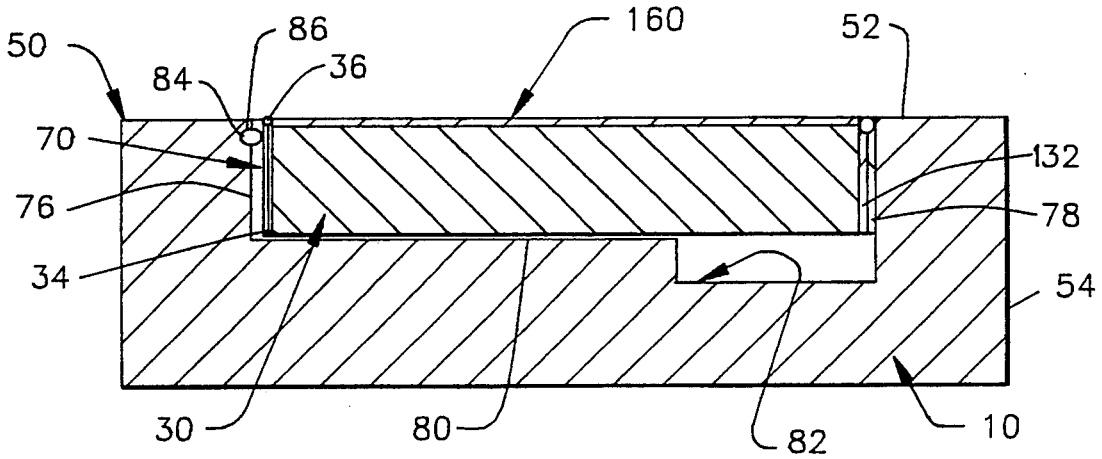
FIG. 7 is a sectional view of the cover apparatus showing the audio system with an integral cover panel in its closed configuration.

In a further embodiment, as shown in FIG. 7, the cover apparatus 10 includes an audio system 30 that is hingedly connected to the front sidewall 78 of recessed cavity 70 by a locking hinge 132. The upper wall 160 of audio system 30 serves as a cover for the audio system 30 and cavity 70, so that a separate cover is not necessary.

Figure 8:
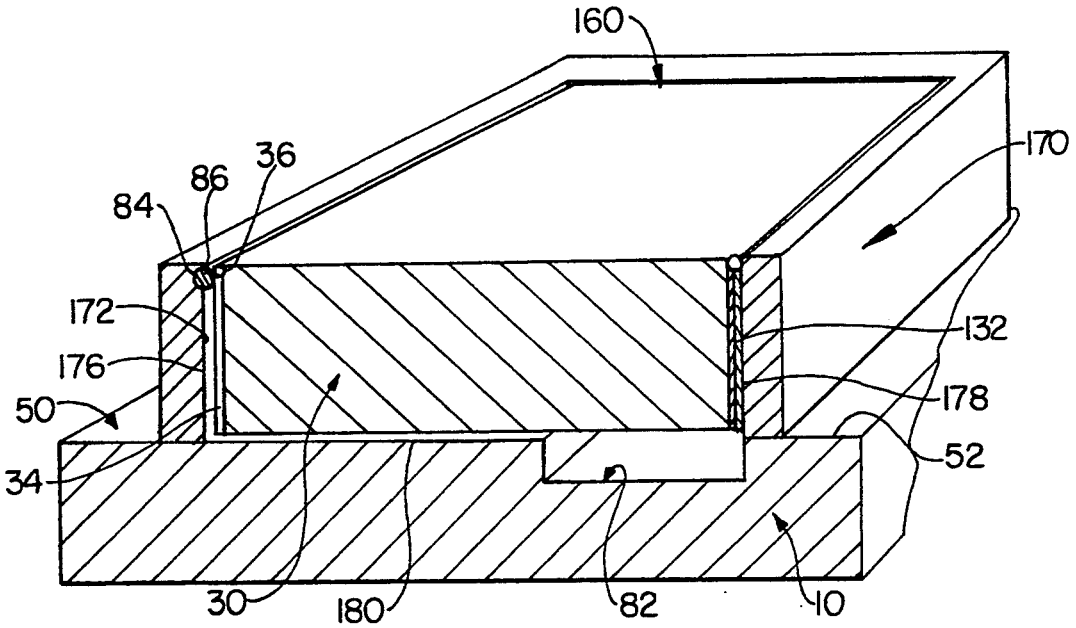
FIG. 8 is a sectional perspective view of the cover apparatus showing an integrally-connected audio-system housing on the top of the cover with an audio system contained therein, in its closed configuration.

In a still further embodiment, as depicted in FIG. 8, the cover apparatus 10 includes an audio housing 170 integrally attached to cover member 50, instead of a recessed cavity 70, as shown in FIGS. 4 and 7. Audio housing 170 has a cavity 172 for receiving audio system 30 therein. Audio system 30 is hingedly connected to the front sidewall 178 of housing 170 by a locking hinge 132. In the upper section of rear sidewalls 176 and adjacent sidewalls (not shown) of housing 170, there is a receiving and holding groove 84 for a sealing gasket 86. The upper wall 160 of audio system 30 serves as a cover for the audio system 30 and cavity 172, so that a separate cover is not necessary.

OPERATION OF THE PRESENT INVENTION

To use and operate the present invention of the cover apparatus 10 and insulated cooler 12 having an audio system 30 contained within the cover member 50, the user places the cooler 12 on a flat surface, such as the ground, a table, chair, or the like. The user is then ready to lift and open the cover panel 60 by inserting a finger in the molded indentation 56 and lifting the cover panel 60 away from the flat-lying audio system 30. The user then lifts up the audio system 30 with an upward hand/-finger motion from the bottom wall 80 of recessed cavity 70.

The audio system 30 is then positioned, as depicted in FIG. 5, such that the top side corner edge 48 is inserted in the indentation 64 on bottom surface 66 of cover panel 60, which holds both the audio system 30 and cover panel in a firm, open, and upright position for hands on use of the audio system 30.

In an another embodiment, as shown in FIG. 6, the audio system is held upright by the insertion of the support stand 38 into indentation 42 located on the bottom wall 80 of recessed cavity 70. The cover panel 60 then leans against the top side corner edge 48 of audio system 30, and the user is now ready to use any function of the audio system 30. For example, if the user wants to hear the AM/FM radio 100, it is simply turned on, and the user then extends the telescoping antenna 34 to a desired length and moves the antenna 34 by way of antenna hinge 36 to a proper location for a clear radio wave reception.

If the user wants to carry the cooler 12 and audio system 30 when in use (with the audio system 30 in its open and upright position) to another location, the cooler carrying handle 16 is moved to a vertical position, as shown in FIG. 3 (which clears the top of both cover panel 60 and audio system 30). The user then lifts the handle 16 and carries the balanced cooler 12 and cover member 50 to the other location without any interruption of music, etc., from audio system 30.

If food and/or beverages are needed, the simple lifting and opening of cover member 50 is achieved by an upward motion of a hand and/or fingers on the molded indentation 58 of cover member 50. The lifting and opening of cover member 50 to a vertical position does not disturb the audio system in any way.

THE ADVANTAGES OF THE PRESENT INVENTION

Accordingly, the primary advantage of the present invention is that it provides a cover apparatus having a built-in audio system that is protected from normal weathering and wear and tear.

Another advantage of the present invention is that it provides a cover apparatus having an audio system which is interchangeable with other cover members for insulated coolers.

Another advantage of the present invention is that it provides a cover apparatus having an audio system that is easily accessible and is simple to set up for use.

Another advantage of the present invention is that it provides a cover apparatus having an audio system, such that the weight and location of the audio system is in the center of the cover member for better balance and ease of carrying the cooler.

Another advantage of the present invention is that it provides a cover apparatus having an audio system which is water and liquid proof by the use of a sealing gasket in the sidewalls of the recessed cavity.

A further advantage of the present invention is that it provides a cover apparatus having an audio system that is interchangeable with standard AM/FM radios, compact disc players, and/or tape cassettes.

A still further advantage of the present invention is that it provides an economical and efficient method of constructing a cover apparatus having a built-in audio system.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A cover apparatus for an insulated cooler having an audio system, comprising:

a) a cover member having a recessed cavity;

b) said recessed cavity having four sidewalls and a bottom wall;

c) an audio system hingedly mounted on one of said sidewalls and movable between a closed position, wherein said audio system lies flat within said recessed cavity, and an open position, wherein said audio system extends out of said recessed cavity for use;

d) a cover panel hingedly mounted on an opposite one of said sidewalls and movable between a closed position, wherein said cover panel closes said recessed cavity and lies flat within said recessed cavity and is disposed above said audio system, and an open position, wherein said cover panel extends out of said recessed cavity; and e) means for supporting said audio system in an open and upright position.

2. The cover apparatus of claim 1, wherein said means for supporting includes a holder for engaging and holding said audio system in said open and upright position.

3. The cover apparatus of claim 2, wherein said holder is said cover panel.

4. The cover apparatus of claim 2, wherein said holder is a stand mounted in said recessed cavity for engaging and holding said audio system.

5. The cover apparatus of claim 4, wherein said stand is hingedly connected to said audio system.

6. The cover apparatus of claim 4, wherein said stand is hingedly connected to said bottom wall of said recessed cavity.

7. The cover apparatus of claim 3, wherein said cover panel includes an indentation for receiving and holding said audio system.

8. The cover apparatus of claim 1, wherein said cover member is made of foam plastic, styrofoam, or aluminum covered insulation.

9. The cover apparatus of claim 1, wherein said audio system is a stereo AM/FM radio, tape cassette, or a compact disc player.

10. The cover apparatus of claim 1, wherein said audio system is a combination of a stereo AM/FM radio, tape cassette, or a compact disc player.

11. The cover apparatus of claim 1, wherein said audio system includes a color television.

12. The cover apparatus of claim 1, wherein said cover panel is in the shape of a circle, square, rectangle, or oval.

13. The cover apparatus of claim 1, wherein said cover member is removable as a whole unit from said cooler or is hingedly connected to the body of said cooler.

14. The cover apparatus of claim 1, wherein said cooler includes a handle that moves up and down and when in the vertical upright position, the handle clears the top of said audio system and cover panel when in their upright and open positions.

15. The cover apparatus of claim 1, wherein said recessed cavity includes a storage compartment formed in the bottom wall of said recessed cavity for storing of keys, batteries, antenna wire, tape cassettes, and/or CDs.

16. The cover apparatus of claim 1, wherein said cover panel includes a sealing gasket to liquid proof said recessed cavity when said cover panel is in said closed position.

17. The cover apparatus of claim 1, wherein said audio system includes an extendable antenna hingedly attached to said audio system for proper audio wave reception.

18. The cover apparatus of claim 1, wherein said recessed cavity includes a sealing gasket located in the upper sidewalls of said recessed cavity to prevent liquid leakage around said cover panel when in said closed position.

19. The cover apparatus of claim 18, wherein said sealing gasket is made of rubber, Teflon, cork, or pliable plastic tubing.

20. A cover apparatus for an insulated cooler having an audio system, comprising:

a) a cover member having a housing;

b) said housing having sidewalls and a bottom wall;

c) an audio system hingedly mounted on one of said sidewalls and movable between a closed position, wherein said audio system lies flat within said housing, and an open position, wherein said audio system extends out of said housing for use;

d) said audio system having an outer wall, wherein said outer wall closes said housing and is disposed above said audio system; and e) means for supporting said audio system in an open and upright position.

* * * * *